United States Patent [19]

Andersen et al.

[11] 3,940,198

[45] Feb. 24, 1976

[54] INTEGRAL MULTIFINGER CONTACT AND METHOD OF MAKING

[75] Inventors: Stephen Verner Andersen, Burbank, Calif.; Edwin Grant Swick, Bartlett, Ill.

[73] Assignee: Illinois Tool Works Inc., Chicago, Ill.

[22] Filed: Mar. 20, 1975

[21] Appl. No.: 560,420

Related U.S. Application Data

[62] Division of Ser. No. 447,616, March 4, 1974, Pat. No. 3,905,318.

[52] U.S. Cl. ..... 339/5 M; 29/163.5 R; 113/116 A; 339/258 R; 339/278 M

[51] Int. Cl.[2] ..... H01R 39/00

[58] Field of Search ..... 29/163.5 R; 113/116 A, 113/116 W, 119; 339/5 M, 5 R, 278 M, 258 RR, 258 A, 258 P, 258 R

[56] References Cited

UNITED STATES PATENTS

| | | | |
|---|---|---|---|
| 2,426,429 | 8/1947 | Bels | 339/258 A |
| 2,692,019 | 10/1954 | Zalkind | 113/116 A X |
| 3,256,510 | 6/1966 | Horssen | 339/258 R X |
| 3,348,192 | 10/1967 | DeVito | 339/258 RR |

*Primary Examiner*—Roy Lake
*Assistant Examiner*—DeWalden W. Jones
*Attorney, Agent, or Firm*—T. W. Buckman; R. W. Beart

[57] ABSTRACT

An integral multifinger contact with each finger being capable of flexing independently of one another while maximizing the number of independent finger contacts along a given contact line. The method involves the shearing of finger portions and elongating these portions during the shearing operation to provide a positive clearance between adjacent edges of the fingers. One embodiment of the invention being directed to a contact member particularly adapted for a rotary potentiometer while another embodiment has particular use in a linear potentiometer.

3 Claims, 10 Drawing Figures

Fig.1
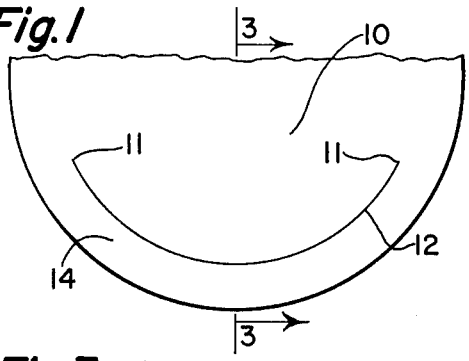
Fig.2
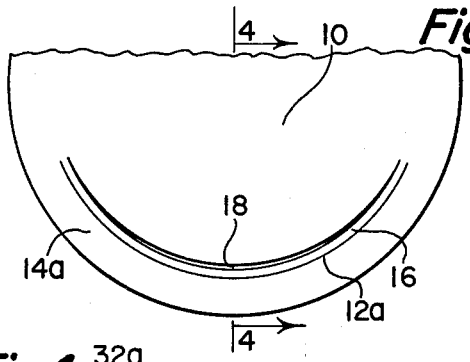
Fig.3
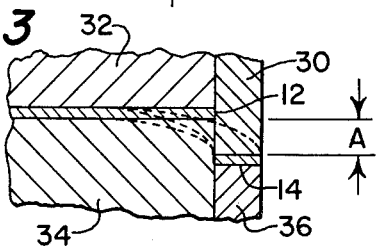
Fig.4
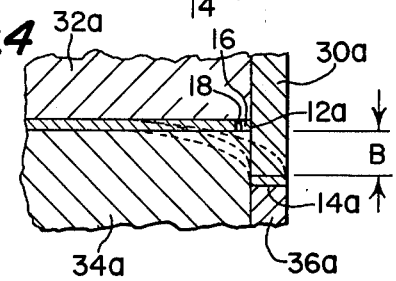
Fig.5
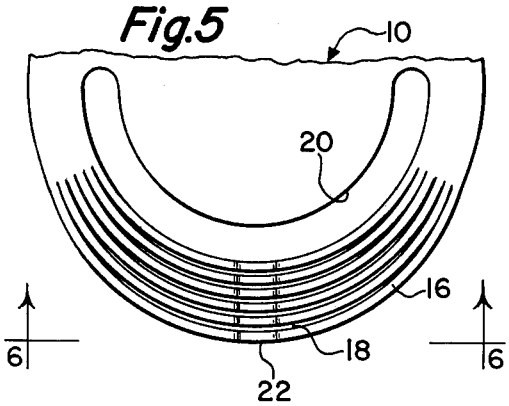
Fig.6
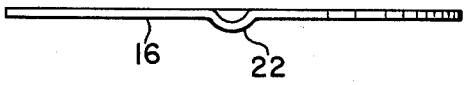
Fig.7
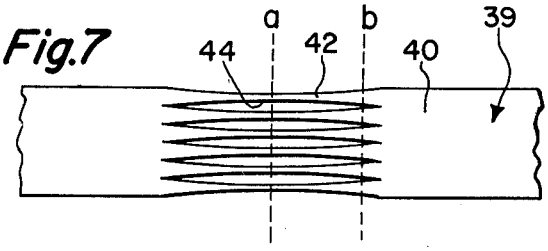
Fig.9
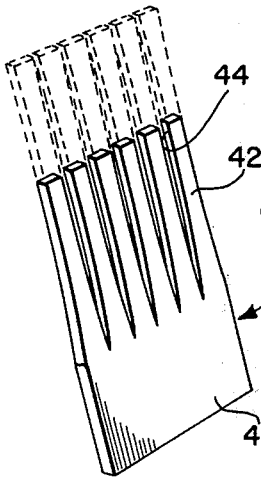
Fig.8
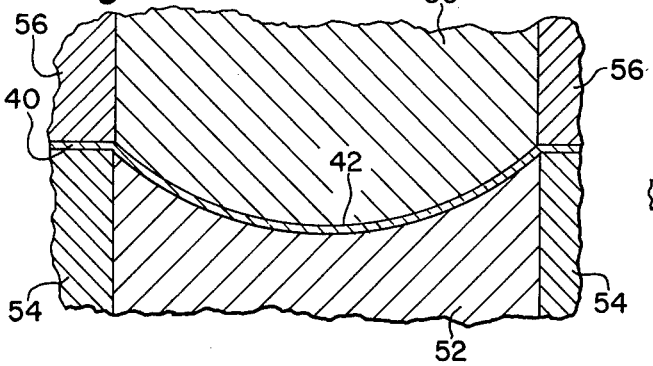
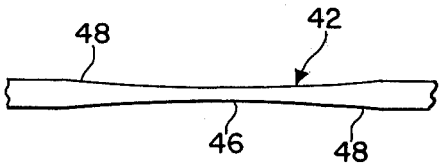
Fig.10

INTEGRAL MULTIFINGER CONTACT AND METHOD OF MAKING

This is a division of application Ser. No. 447,616, filed Mar. 4, 1974, now U.S. Pat. No. 3,905,318.

BACKGROUND OF THE INVENTION

This invention relates to an electrical contact member and more particularly of the type used in a variable resistance device having a movable contact or wiper, such as a potentiometer.

There have been numerous prior art efforts to provide an acceptable and yet inexpensive multifinger contact serving as the wiper element in these devices. One such method of producing a multifinger contact involves the winding of a conductive wire about a mandrel, plating the wound wire with conductive material and selectively removing the plating to produce severable contacts having a plurality of fingers and a base portion. This method necessarily involves several complicated and expensive steps. A typical method of producing an inexpensive multifinger contact involves merely slotting and removing material in a strip to produce a plurality of finger members extending from the base which are spaced from one another. This method will not provide a plurality of densely arranged slender fingers necessary to maximize the number of fingers over a given area to be contacted. Efforts have also been made to shear adjacent finger portions from one another. This tends to leave the fingers in lateral contact with one another and, thus, restricts the capability of each finger to flex independently.

SUMMARY OF THE INVENTION

The present invention basically utilizes a shearing process in which the shearing of one portion of a stock from another is accomplished with a stroke large enough to elongate the sheared portion beyond its elastic limit. When the fingers are returned to a coplanar position, they will, thus, include a slight lateral spacing between adjacent side edges.

One embodiment of the invention utilizes the elongation of adjacent finger portions to be particularly adapted in use as a wiper in a rotary-type potentiometer.

In such an embodiment, a succession of arcuate shears are performed on a sheet of conductive material. Each adjacent shearing step being such a depth as to elongate the material beyond its elastic limit. Upon returning the plurality of sheared portions to a coplanar position, a crescent shaped space will be provided between adjacent edges due to the differential in lengths of adjacent sheared portions.

Another embodiment of the invention again utilizes the elongation of adjacent finger portions but is particularly adapted for use in a rectilinear potentiometer. In such an embodiment, a plurality of parallel linear fingers are sheared from one another, each being sheared downwardly to a point which is beyond the elastic limit of the material thereby causing at least a portion of the length of the finger to be diminished in width as a result of the elongation. The fingers, when returned to a coplanar position, will thus be capable of individually flexing as a result of the diminishment in width of the fingers.

Accordingly, it is an important object of the invention to provide a multifinger contact member made by a shearing operation, the fingers of which are capable of independently flexing.

Another object of the invention is to elongate, while shearing, the finger portions from a sheet of material thus allowing a dense arrangement of such fingers on a relatively small contact member and yet allow the fingers to flex independently.

An additional object of the invention is to provide a procedure for forming relatively small integral multifinger electrical contact members which utilizes a series of punch and die stations contributing to reduction of manufacturing costs.

The above and other objects and advantages of the invention will be more fully understood from the following specification when read with the accompanying drawings.

BRIEF DESCRIPTION OF THE DRAWINGS

FIG. 1 is a plan view of a portion of a strip following a first shearing step in the operation.

FIG. 2 is a plan view of the portion of the strip of FIG. 1 showing the first sheared portion returned to the coplanar position and showing a second shearing step in the material.

FIG. 3 is a partial cross-sectional view of the punch and die set at a first station in the invention and showing the punch at the bottommost position of a stroke.

FIG. 4 is a partial cross-sectional view of a second punch and die station showing the punch at the bottommost position of its stroke in a shearing operation following that shown by FIG. 3.

FIG. 5 is a partial plan view of a multifinger contact made in accordance with the invention.

FIG. 6 is an end view of the contact member shown in FIG. 5.

FIG. 7 is a partial plan view of a strip of material deformed in accordance with an alternate embodiment of the invention.

FIG. 8 is a partial cross-sectional view of a punch and die set used to form the alternate embodiment shown in FIG. 7.

FIG. 9 is a perspective view of a multifinger contact made in accordance with the embodiment shown in FIGS. 7 and 8.

FIG. 10 is a partial plan view of an individual finger deformed in accordance with the alternate embodiment shown in FIG. 8.

DETAILED DESCRIPTION OF THE PREFERRED EMBODIMENTS

Integral multifinger contact members in which each finger is capable of independent action, may be efficiently made with the method of the present invention. The method utilizes shearing operations in each of the to be described embodiments and relies on the elongation of thin strips of material beyond their elastic limits to insure this independent action. During the shearing step in the formation of each individual member, the finger member is moved out of the plane of the strip a depth which is sufficient to deform that particular portion beyond its elastic limit so that it will not return to its original dimension. Of course, it will be realized that the actual depth of each shearing stroke to go beyond the elastic limit of the material will depend on the length of material being deformed as well as the characteristics of the material itself. Therefore, the actual dimensions of the punch and die set utilized in this invention will become apparent to those skilled in the art in accordance with the particular requirements of the contact member to be produced. Examples of material which has been used in the environment described above is brass or nickel-silver alloys. It should be noted that these particular materials are merely exemplary and not restrictive of the materials which may be used in the invention.

One embodiment of the invention utilizes a differential elongation in adjacent finger portions to produce a slight lateral space between adjacent and opposing side edges of the fingers. While extremities of an arcuate shear line are retained from elongation, a slender portion of the material is elongated beyond the elastic limit of the material and out of the plane of the strip. When each finger portion is returned to the plane of the strip, the difference in length will be reflected in a crescent shaped space between adjacent fingers.

Yet another embodiment of the invention utilizes the change in a lateral dimension in a slender finger portion as a result of elongation to insure that adjacent finger portions will not contact one another.

Turning now to FIG. 1, it will be seen that a portion of a strip of conductive material may be sheared along an arcuate shear line 12. The portion 14 on the convex side of the shear line will be deformed out of the plane of the strip. The shear line 12 will lie on one side of an imaginary line interconnecting the extremities 11 and the portion of the strip in the sectors outside of the sector defining the sheared portion will be clamped and retained in a coplanar position while the portion 14 is transversely deformed.

FIG. 3 represents a punch and die set which may be utilized, in accordance with the principles of the invention, to shear an arcuate shaped portion 14 from a strip 10 such as that depicted in FIG. 1. An upper punch 30 which will have an arcuate shaped cutting or shearing edge conforming to the desired configuration of the shear line 12, will be associated with a lower spring loaded pressure pad 36. A lower die portion 34 will also be associated with an upper spring loaded pressure pad 32. The portions 34 and 32 will serve to support and clamp the portions of the strip 10 outside of the arc of shear as well as supporting and clamping portions of the strip within the arc of the shear and on the concave side of the shear line 12. As the upper portions 30 and 32 are moved relative to the lower portions 34 and 36, the punch 30 will sever a predetermined portion 14 from the body of the strip and move portion 14 downwardly to a predetermined maximum depth A. This maximum depth A will be sufficient to elongate the portion 14 beyond its elastic limit.

Reference to FIG. 2 will now show that when the sheared portion 14 has been returned to be coplanar with the strip 10 the difference in lengths between the adjacent edges of the body 10 on the inner or concave side of the shear line and the portion 14 on the outer or convex side of the shear line will provide a crescent shaped gap 18 therebetween. A succession of similar shearing operations will thereafter be performed on the strip. A subsequent shear will thus be made on the previously deformed portion 14 and is shown as a shear line 12*a* similar to the arcuate shaped initial shear line 12. In this step, however, a slender finger portion 16 remains in the plane of the strip 10 while a segment 14*a*, of the initially deformed portion 14, is sheared out of the plane of the strip to a distance B. The shearing of portion 14 to the predetermined maximum depth A will work harden portion 14 to the extent that its elastic properties will have changed, consequently the distance B must be a depth sufficient to further elongate portion 14*a* beyond its redefined elastic limit. While distance B is shown to be greater than distance A and for practical purposes will probably be greater when the shear lines are progressively longer in length, it should be understood that B is only required to be great enough to exceed the redefined elastic limit of 14*a*. This subsequent shearing strip will thus elongate portion 14*a* an extent greater than the previously elongated portion, now represented by finger 18. In this second station an arcuate punch 30*a* cooperates with a spring loaded pressure pad 36*a*, while a die portion 34*a* cooperates with a spring loaded pressure pad 32*a* in a manner somewhat identical to the description of the first shearing station.

After a predetermined number of shearing strokes to depths determined by the depth required to alongate the portion beyond its elastic limit, a contact member as shown in FIG. 5 will result. A plurality of individual fingers 16 will be formed, each being spaced slightly from the adjacent fingers by a crescent shaped gap 18. The spacings will thus allow fingers 16 to flex relatively independent of one another and yet maintain an extremely dense array of contact members along a predetermined short line of contact. The strip 10 may furhter be deformed by a provision of a cut-out 20. The portion of the body on the concave side of cut-out 20 may thereafter be deformed in accordance with the particular requirements of attachment or may be deformed to provide a collector brushing element which would cooperate with the plurality of members 16 for particular use in a potentiometer environment. The centermost portions of the arcuate fingers 16 may also be deformed further to provide a radiused tip 22 to localize the contacting portion of each individual finger.

The arcuate fingers formed in the manner described above and with punches having somewhat identical arc configurations, will be narrowed somewhat at a portion intermediate the extremities.

The basic teachings of the invention can also be utilized to produce an integral multifinger brush in which the fingers are generally linear. FIG. 7 shows a strip 39 which has been deformed utilizing the principles of this invention to provide a plurality of fingers 42 merging with and along one edge of a base portion 40. It will be noted that each finger 42 is substantially out of lateral contact with each other and is separated from each other by spaces 44. This configuration will thus allow the fingers 42 to flex independent of one another.

FIG. 8 describes a punch and die station which may be utilized to provide the deformation of a strip as shown in FIG. 7. A punch 50 having a generally curved advancing edge is associated with a lower spring loaded pressure pad 52. Upper spring loaded pressure pad portions 56 cooperate with lower stationary die members 54 to retain the strip at the extremities of the fingers to be formed. As in the previously described embodiment, the maximum depth of deformation of portions 42 from the plane of the stock will be such that the elastic limit of the material is exceeded. The finger portions 42 will thus be elongated and deformed so as to diminish in width towards an intermediate portion of the fingers. In FIG. 10 it will be seen that each finger 42 will include a necked down or portion of diminished width 46 and wider portions 48 merging with the strip material 39. When the deformed fingers 42 are returned to a position coplanar with the strip, the diminishment of width will form sufficient spaces between adjacent fingers to permit individual and independent flexing thereof.

An integral multifinger contact member 38 shown in FIG. 9, may subsequently be formed from a plurality of such deformations on a strip. The fingers may be severed along cut lines *a* or *b* or positions intermediate thereof. A severing along line *b* at portion 48 is shown in phantom in FIG. 9 and would represent a dense arrangement of individually flexing contact points along a given line of contact. It should also be noted that the contact made by severing along cut line b would produce fingers with narrowed portions 44 to facilitate twisting about their own longitudinal axis, which capability may be advantageous in certain environments. Severing along cut line a at the area of diminished width 44 results in the most efficient use of material since a pair of elements 38 could be produced from a set of elongated fingers 42.

It will also be recognized that the elongation beyond the elastic limits of the material and work hardening thereof may serve to enhance the spring characteristics of the device.

While the invention has been described in connection with two particular embodiments, it should be understood that it is not intended to limit the invention to such embodiments. On the contrary, it is intended to cover all alternatives, modifications and equivalents as may be included within the spirit and scope of the invention as defined by the appended claims.

We claim:

1. A one piece electrical wiper brush contact including a base portion adapted for attachment to a carrier, a plurality of slender, resilient, arc-like contact fingers, each extremity thereof integrally joined to the base, said contact fingers merging together at both regions of juncture with the base, the side edges of adjacent arc-like fingers being separated over substantially their entire length by a crescent shaped aperture, dimpled localized contact regions being formed in the fingers and substantially radially aligned thereon.

2. A one piece wiper brush contact as in claim 1, wherein the localized contact regions are located substantially midway the extremities of the fingers and in the area of maximum spacing between adjacent arc-like fingers.

3. An electrical contact brush as in claim 1, wherein each contact finger includes a necked down portion of a width less than the width of the fingers at the region of merger with the base.

* * * * *